US011365530B2

(12) United States Patent
Wells et al.

(10) Patent No.: US 11,365,530 B2
(45) Date of Patent: Jun. 21, 2022

(54) RETAINER SLEEVE

(71) Applicant: Caterpillar Inc., Deerfield, IL (US)

(72) Inventors: Corey Wells, Peoria, IL (US); Jason Jura, Peoria, IL (US); Eric Sinn, Tremont, IL (US); Doug Serrurier, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 503 days.

(21) Appl. No.: 16/430,209

(22) Filed: Jun. 3, 2019

(65) Prior Publication Data

US 2020/0378092 A1 Dec. 3, 2020

(51) Int. Cl.
*E02F 9/28* (2006.01)

(52) U.S. Cl.
CPC ..... *E02F 9/2841* (2013.01); *E02F 9/2808* (2013.01); *E02F 9/2825* (2013.01)

(58) Field of Classification Search
CPC ..... E02F 9/2833; E02F 9/2841
See application file for complete search history.

(56) References Cited

U.S. PATENT DOCUMENTS

| | | | | |
|---|---|---|---|---|
| 2,506,404 | A * | 5/1950 | Morton | F16C 27/02 384/535 |
| 3,767,266 | A * | 10/1973 | Krekeler | E21C 35/197 299/107 |
| 3,832,077 | A * | 8/1974 | Von Mehren | F16B 21/125 403/379.4 |
| 4,727,663 | A * | 3/1988 | Hahn | E02F 9/2841 37/458 |
| 7,670,079 | B2 * | 3/2010 | Snadden | F16C 27/04 403/372 |
| 7,878,554 | B2 * | 2/2011 | Le Bars | F16L 37/0915 285/340 |
| 8,267,592 | B2 * | 9/2012 | Godleski | F01D 25/164 384/558 |
| 9,074,351 | B2 | 7/2015 | Ballinger | |
| 9,309,651 | B2 * | 4/2016 | Jeske | E02F 9/2841 |
| 9,328,484 | B2 | 5/2016 | Campomanes | |
| 10,544,568 | B2 * | 1/2020 | Serrurier | G05B 19/4099 |
| 11,118,329 | B2 * | 9/2021 | Jura | E02F 3/40 |
| 11,124,951 | B2 * | 9/2021 | Wells | E02F 9/2841 |
| 2003/0070330 | A1 | 4/2003 | Olds et al. | |
| 2013/0145659 | A1 | 6/2013 | Lahood et al. | |
| 2017/0328037 | A1 | 11/2017 | Serrurier et al. | |
| 2020/0131742 | A1 * | 4/2020 | Serrurier | B29C 64/393 |
| 2020/0378093 | A1 * | 12/2020 | Wells | E02F 9/2841 |

FOREIGN PATENT DOCUMENTS

| | | |
|---|---|---|
| CN | 86209610 | 12/1987 |
| GB | 2490455 B | 10/2012 |
| WO | 2007025687 A1 | 3/2007 |
| WO | 2008021376 | 2/2008 |

* cited by examiner

*Primary Examiner* — Gary S Hartmann
(74) *Attorney, Agent, or Firm* — Procopio, Cory, Hargreaves & Savitch LLP

(57) ABSTRACT

A retainer sleeve for use with a lock in a ground engaging tool. The retainer sleeve can include a skirt extending part way around a retainer axis to form a portion of an annulus. The retainer sleeve can further include a plurality of legs joined to the skirt and formed to mate with a lock cavity of the ground engaging tool. The plurality of legs can form an inner surface shaped to rotatably receive an outer surface of the lock.

17 Claims, 5 Drawing Sheets

RETAINER SLEEVE

TECHNICAL FIELD

The present disclosure generally pertains to ground engaging tools. More particularly this application is directed toward a retainer sleeve.

BACKGROUND

Earth-working machines, such as, for example, excavators, wheel loaders, hydraulic mining shovels, cable shovels, bucket wheels, bulldozers, and draglines, are generally used for digging or ripping into the earth or rock and/or moving loosened work material from one place to another at a worksite. These earth-working machines include various earth-working implements, such as a bucket or a blade, for excavating or moving the work material. These implements can be subjected to extreme wear from the abrasion and impacts experienced during the earth-working applications.

To protect these implements against wear, and thereby prolong the useful life of the implements, various ground engaging tools, such as teeth, edge protectors, and other wear members, can be provided to the earth-working implements in the areas where the most damaging abrasions and impacts occur. These ground engaging tools are removably attached to the implements using customized retainer systems, so that worn or damaged ground engaging tools can be readily removed and replaced with new ground engaging tools.

Many retainer systems have been proposed and used for removably attaching various ground engaging tools to earth-working implements. One example of such retainer system is described in U.S. Publication Number 2017/0328037 to Serrurier et al. The disclosed retainer system includes a retainer sleeve configured for use in a retainer system for a ground engaging tool includes a plurality of plate-like sections, each section being flexibly joined with an adjacent section along either a radially inner edge or a portion of a radially outer edge. The radially inner edges of the plurality of sections form part of a segmented inner surface configured for engagement with an outer surface of a locking member of the retainer system. The inner surface extends partially around a central axis of the retainer sleeve to form a substantially C-shaped retainer sleeve having opposite circumferential ends that are spaced from each other. The radially outer edges of the plurality of sections form part of a segmented, frustoconical outer surface configured for engagement in an internal lock cavity of a ground engaging tool tip.

The present disclosure is directed toward overcoming one or more of the problems discovered by the inventors.

SUMMARY

A retainer sleeve for use with a lock in a ground engaging tool with a lock cavity, the lock having with an outer surface and a detent recess in a ground engaging tool with a lock cavity is disclosed herein. The retainer sleeve includes a skirt extending part way around a retainer axis to form a portion of an annulus. The retainer sleeve further including a plurality of legs joined to the skirt and formed to mate with the lock cavity of the ground engaging tool, the plurality of legs forming an inner surface shaped to rotatably receive the outer surface of the lock.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Some of the surfaces have been left out or exaggerated for clarity and ease of explanation.

Figure 1:
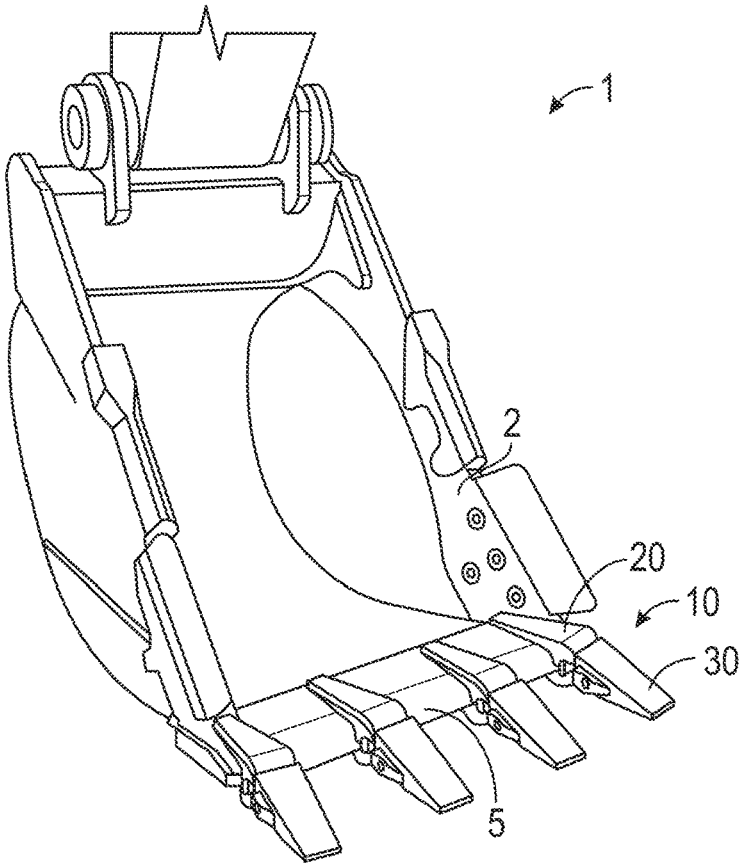
FIG. 1 is a perspective view of a loader bucket having a plurality of ground engaging tools attached thereto according to an exemplary embodiment.

FIG. 1 is a perspective view of a loader bucket having a plurality of ground engaging tools attached thereto according to an exemplary embodiment. FIG. 1 illustrates an excavator bucket assembly 1 as an exemplary implement of an earth-working machine. Excavator bucket assembly 1 includes a bucket 2 used for excavating work material in a known manner. Bucket 2 may include a variety of ground engaging tools. For example, bucket 2 may include a plurality of tooth assemblies 10, as ground engaging tools, attached to a base edge 5 of bucket 2. Tooth assemblies 10 may be secured to bucket 2 employing retainer systems according to the present disclosure. While various embodiments of the present disclosure will be described in connection with a particular ground engaging tool (e.g., tooth assembly 10), it should be understood that the present disclosure may be applied to, or used in connection with, any other type of ground engaging tools or components. Further, it should be understood that one or more features described in connection with one embodiment can be implemented in any of the other disclosed embodiments unless otherwise specifically noted.

Figure 2:
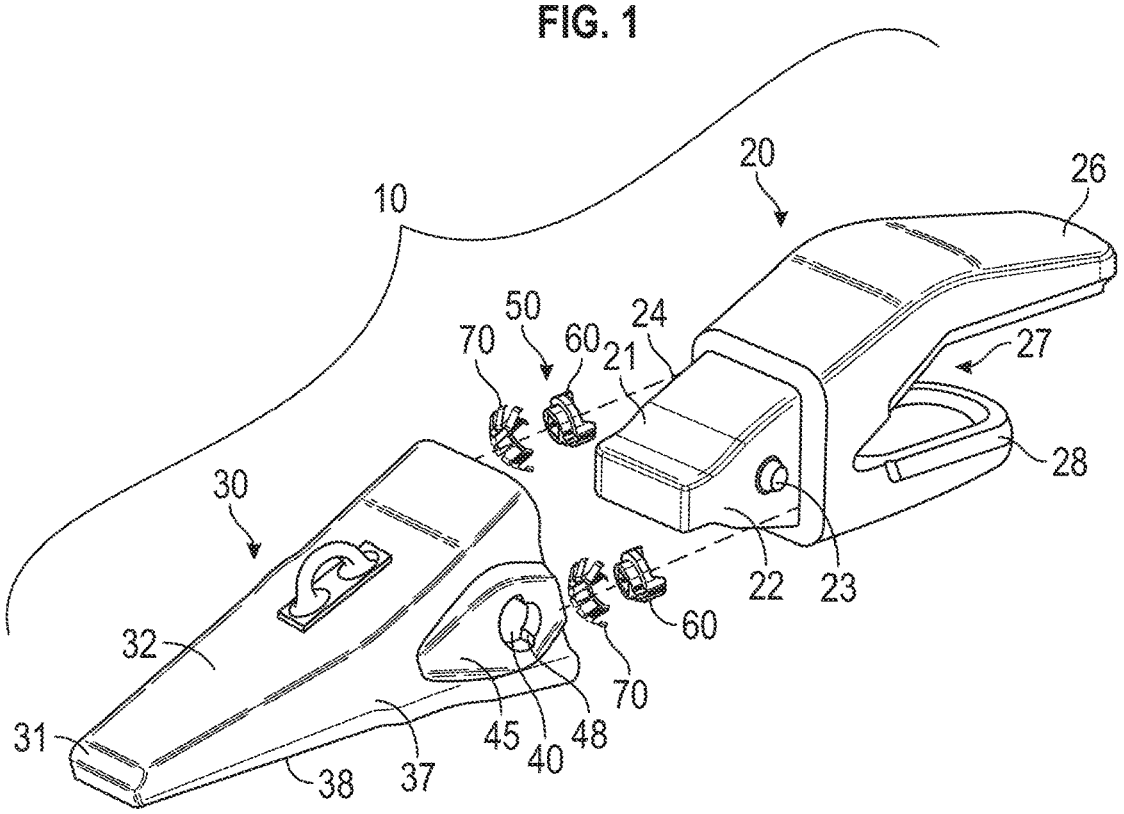
FIG. 2 is an exploded perspective view of a tooth assembly according to an exemplary embodiment.

FIG. 2 is an exploded perspective view of a tooth assembly according to an exemplary embodiment. The tooth assembly 10 may include an adapter 20 configured to engage base edge 5 of bucket 2 or other suitable support structure of an implement. Tooth assembly 10 may also include a ground-engaging tip, or tip, 30 formed to be removably attached to adapter 20. Tooth assembly 10 may further include a retainer system 50 formed to secure tip 30 to adapter 20. Tip 30 endures the majority of the impact and abrasion caused by engagement with work material, and wears down more quickly and breaks more frequently than adapter 20. Consequently, multiple tips 30 may be attached to adapter 20, worn down, and replaced before adapter 20 itself needs to be replaced. As will be detailed herein, various exemplary embodiments of retainer system 50, consistent with the present disclosure, may facilitate attachment and detachment of ground engaging tools and tips 30 to and from the adapter 20 attached to an implement.

Adapter 20 may include a pair of first and second mounting legs 26, 28 defining a recess 27 there between for receiving base edge 5. Adapter 20 may be secured in place on base edge 5 by attaching first mounting leg 26 and second mounting leg 28 to base edge 5 using any suitable connection method. For example, mounting legs 26 and 28 and base edge 5 may have corresponding apertures (not shown) through which any suitable fasteners such as bolts or rivets may be inserted to hold adapter 20 in place. Alternatively or additionally, mounting legs 26 and 28 may be welded to the corresponding top and bottom surfaces of base edge 5. Any other connection method and/or configuration known in the art may be used alternatively or additionally. For example, in some exemplary embodiments, an adapter 20 may be configured to use any of the retainer systems 50 disclosed herein to secure the adapter 20 to a ground engaging tip 30.

The adapter 20 may include a nose 21 extending in a forward direction. Nose 21 may be configured to be received in a mounting cavity 35 (shown in FIG. 3) of tip 30. Nose 21 may be configured to support tip 30 during use of bucket 2 and to facilitate retention of tip 30 on nose 21 when bearing the load of the work material.

Nose 21 may include an integral post 23 extending from each lateral side 22, 24. Post 23 may have various shapes and sizes. In one exemplary embodiment, as shown in FIG. 2, post 23 may have a frustoconical shape. As will be described in more detail herein, posts 23 may cooperate with retainer system 50 to secure tip 30 to adapter 20.

Figure 3:
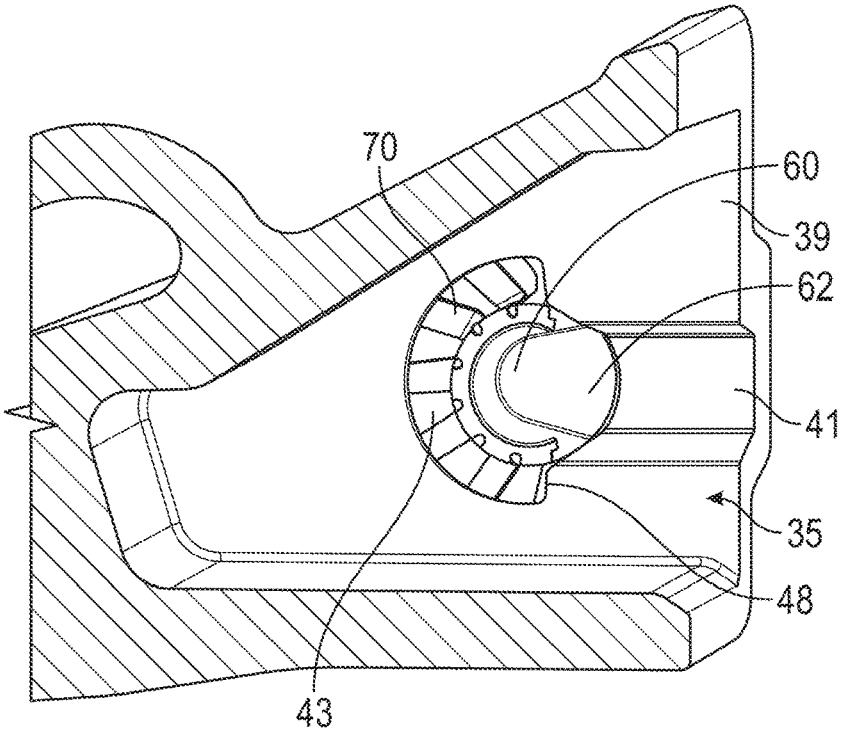
FIG. 3 is a cross section of a portion of the tip of the tooth assembly shown in FIG. 2, with a lock and a retainer sleeve positioned in a lock cavity of the tip.

FIG. 3 is a cross section of a portion of the tip of the tooth assembly shown in FIG. 2, with a lock and a retainer sleeve positioned in a lock cavity of the tip. Tip 30 may define mounting cavity 35 inside tip 30 having a complementary configuration relative to nose 21 of adapter 20. Tip 30 may have various outer shapes.

For example, looking back at FIG. 2, tip 30 may generally taper as it extends forward. For example, an upper surface 32 of tip 30 may slope downward as it extends forward, and a lower surface 38 of tip 30 may extend generally upward as it extends forward. Alternatively, lower surface 38 may extend generally straight or downward as it extends forward. At its forward end, tip 30 may have a wedge-shaped edge 31.

Referring to FIG. 2, tip 30 may be secured to adapter 20 via retainer system 50. Retainer system 50 may include a lock 60 and a retainer sleeve 70. Tip 30 and/or adapter 20 may have various configurations for accommodating lock 60 and retainer sleeve 70 therein. For example, in the exemplary embodiment shown in FIGS. 2 and 3, tip 30 may include a lock cavity 40 in each of its lateral sides 37 for housing the lock 60 and retainer sleeve 70. Lock 60 and retainer sleeve 70 may be seated within lock cavity 40 when assembled to tip 30. Tip 30 may also include a lock bulge 45 extending outward of each lock cavity 40. While the exemplary embodiment shown in FIG. 2 has lock cavity 40 and lock bulge 45 on each lateral side 37 of tip 30, tip 30 may have different numbers and/or arrangements of lock cavities 40 and lock bulges 45.

Figure 4:
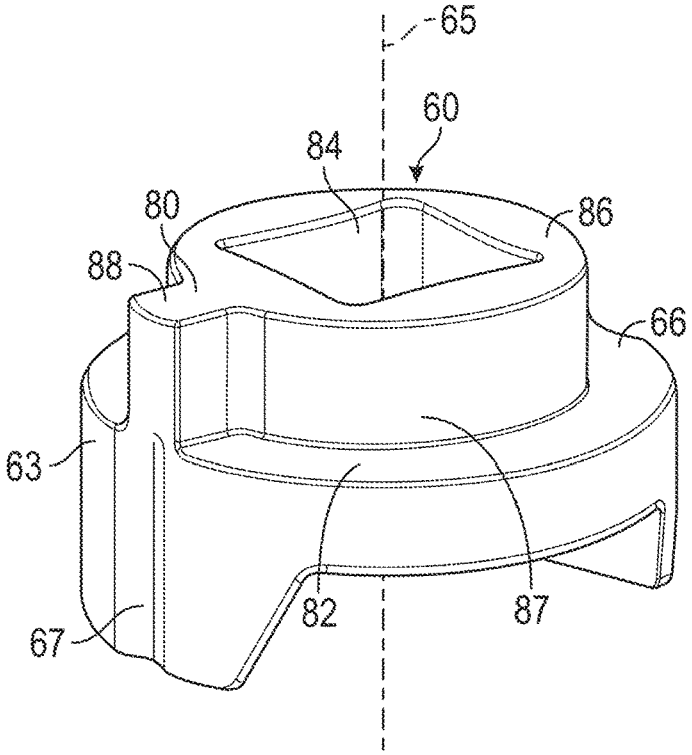
FIG. 4 is a perspective view of the lock of the retainer system from FIG. 2.

FIG. 4 is a perspective view of the lock of the retainer system from FIG. 2. The lock 60 can include lock skirt 63 with an outer surface 66 that may be extend circumferentially around and concentric with lock rotation axis 65. The lock skirt 63 can be substantially cylindrically shaped or conically shaped. The lock skirt 63 can have a detent recess 67 that may extend radially inward from outer surface 66 of lock skirt 63. Detent recesses 67 may include a concave surface, such as a constant-radius curved surface, extending radially inward from outer surface 66.

Lock 60 may also include a head portion 80 attached to lock skirt 63 adjacent an end of lock skirt 63. The head portion 80 may include a wall 82 extending in a plane substantially perpendicular to lock rotation axis 65 and across the end of lock skirt 63 adjacent to the head portion 80. The head portion 80 can include a projection 86 extending from wall 82 away from lock skirt 63 along lock rotation axis 65. Projection 86 may include a substantially cylindrical outer surface 87 extending around most of lock rotation axis 65 and a lock tab 88 extending radially outward relative to lock rotation axis 65.

Lock 60 may also include a tool interface 84 in head portion 80 to facilitate rotating lock 60 about lock rotation axis 65. Tool interface 84 may include any type of features formed to be engaged by a tool for applying torque to lock 60 about lock rotation axis 65. For example, tool interface 84 may include a socket recess with a cross-section formed to engage a socket driver, such as a socket wrench. When lock 60 is seated within lock cavity 40, head portion 80 defining tool interface 84 may extend at least partially through lock cavity 40 and lock bulges 45, and lock cavity 40 may provide an access opening for a tool to engage tool interface 84.

Figure 5:
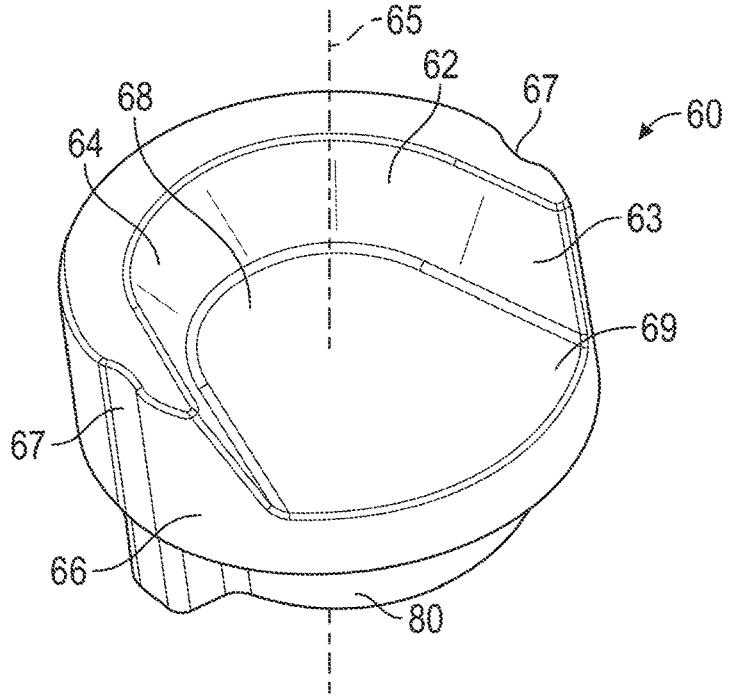
FIG. 5 is a perspective view of the lock shown in FIG. 4.

FIG. 5 is a perspective view of the lock shown in FIG. 4. Lock 60 may be formed to receive at least part of post 23 of adapter 20. Lock 60 may include a lock slot 62 extending into lock skirt 63. Lock slot 62 may have an open end 69 between two circumferential ends of lock skirt 63 and a closed end 68 adjacent a middle portion of lock skirt 63. In some embodiments, lock slot 62 may have a size and shape such that it can receive frustoconical post 23 of adapter 20. An inner surface 64 of lock skirt 63 may be sloped so as to mate with frustoconical post 23 of adapter 20 adjacent closed end 68 of lock slot 62.

In some embodiments, wall 82 may fully enclose the side of lock slot 62 adjacent the head portion 80. The side of head portion 80 opposite lock slot 62 may include a projection 86 extending from wall 82 away from lock skirt 63 along lock rotation axis 65. In some exemplary embodiments, lock tab 88 may extend transverse relative to the direction that lock slot 62 extends from open end 69 to closed end 68.

Referring back to FIG. 3, lock 60 and retainer sleeve 70 may be formed to seat within an inner surface 43 of lock cavity 40 in a manner allowing lock 60 to rotate at least partially around a lock rotation axis 65 (FIGS. 4 and 5) relative to retainer sleeve 70. Retainer sleeve 70 may seat directly against inner surface 43 of lock cavity 40, and lock 60 may seat against inner surface 79 of retainer sleeve 70. On the rear side of lock cavity 40, lock cavity 40 may open into a side slot 41 that extends rearward from lock cavity 40 along an inner surface 39 of lateral side 37. Side slot 41 may have a cross-section configured to allow passage of at least a portion of post 23 of adapter 20 being inserted from the rear end of tip 30.

Figure 6:
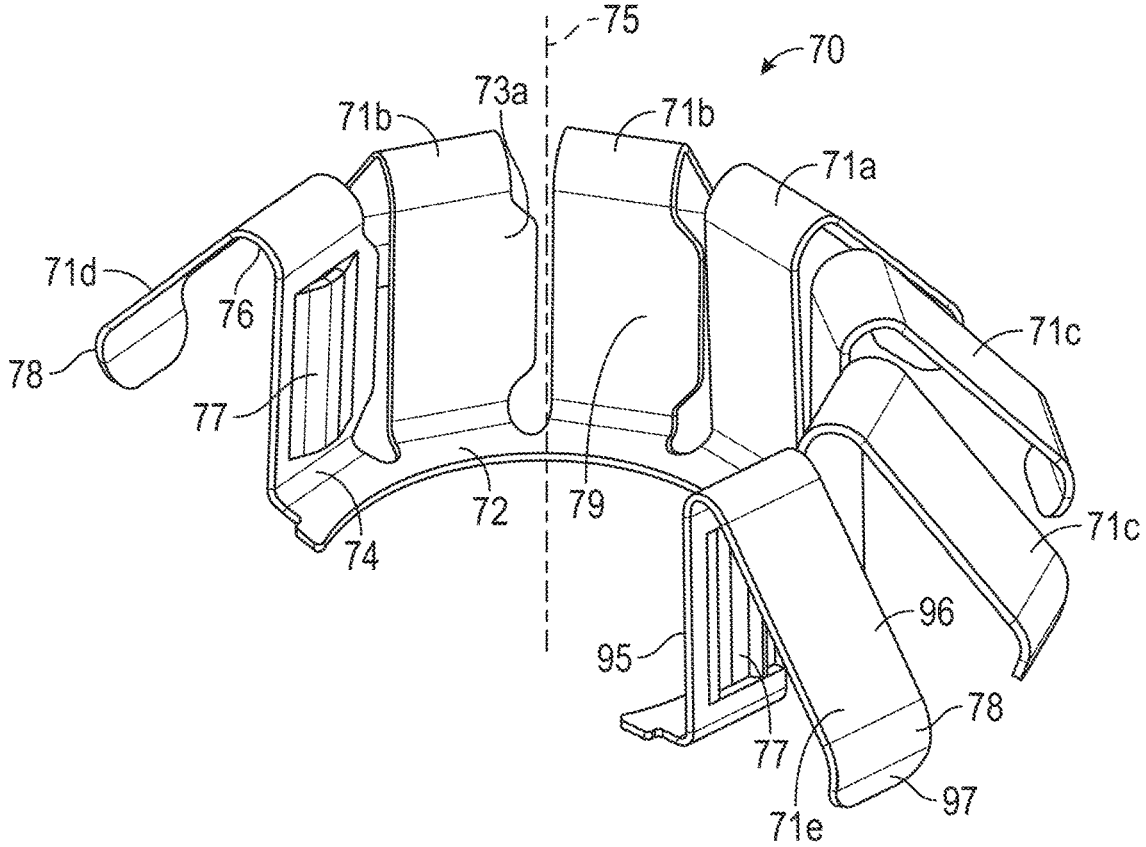
FIG. 6 is a perspective view of the retainer sleeve of the retainer system from FIG. 2.

FIG. 6 is perspective view of the retainer sleeve from FIG. 2. Retainer sleeve 70 can include an inner skirt 72 extending circumferentially around and concentric with retainer axis 75. Accordingly, skirt 72 may extend circumferentially around and concentric with lock rotation axis 65 when retainer sleeve 70 is assembled with lock 60 in lock cavity 40. The skirt 72 may form a portion of an annulus, such as a continuous "C" shape that extends part way around a retainer axis 75. The skirt 72 may extend 180 degrees or more around the retainer axis 75. In some exemplary embodiments, skirt 72 may extend approximately the same angular degree around retainer axis 75 as inner surface 43 of lock cavity 40 extends around lock rotation axis 65. The skirt 72 can have opposite circumferential ends that are spaced from each other. The skirt 72 can be formed to receive the lock 60.

The retainer sleeve 70 can be formed to include a center leg 71*a* disposed centrally with respect to the circumferential ends of the skirt 72. The retainer sleeve 70 includes an end leg 71*d* that can be disposed proximate to the left circumferential end of the skirt 72. The retainer sleeve 70 includes an end leg 71*e* that can be disposed proximate to the right circumferential end of the skirt 72. The retainer sleeve 70 can include left legs 71*b* that can be disposed to the left of the center leg 71*a*, between the center leg 71*a* and the end leg 71*d*. The retainer sleeve 70 can include right legs 71*c* that can be disposed to the right of the center leg 71*a*, between the center leg 71*a* and the end leg 71*e*.

The plurality of legs 71*a*, 71*b*, 71*c*, 71*d*, 71*e* can extend from the skirt 72 of the retainer sleeve 70. Each of the legs 71*a*, 71*b*, 71*c*, 71*d*, 71*e* can be flexibly joined to a skirt 72 by a first bend 74. Alternatively, each of the legs 71*a*, 71*b*, 71*c*, 71*d*, 71*e* can include a first bend 74. The multiple legs 71*a*, 71*b*, 71*c*, 71*d*, 71*e* can be joined around the skirt 72 and form a segmented, non-continuous inner surface 79. In an embodiment shown in FIG. 6, the retainer sleeve 70 comprises seven legs 71*a*, 71*b*, 71*c*, 71*d*, 71*e*. Alternatively, the retainer sleeve 70 can include two, three, four, five, six, eight, nine, or more legs 71*a*, 71*b*, 71*c*, 71*d*, 71*e*.

The legs 71*a*, 71*b*, 71*c*, 71*d*, 71*e* may form a segmented, frustoconical outer surface configured into a segmented "C" shape and formed for engagement in lock cavity 40 of ground engaging tool tip 30. The legs 71*a*, 71*b*, 71*c*, 71*d*, 71*e* can be flexibly joined to the skirt 72 such that the retainer sleeve 70 is compressible for insertion into lock cavity 40, and expandable when the retainer sleeve 70 seats inside lock cavity 40. The legs 71*d*, 71*e* can further include detent projections 77 extending inward towards the retainer axis 75. The legs 71*a*, 71*b*, 71*c*, 71*d*, 71*e* can include multiple sections including first bend 74, a first extension 95, a second bend 76, a second extension 96, a third bend 78, and a third extension 97.

The first bend 74 can flexibly extend outward and generally transverse from the skirt 72 in respect to the retainer axis 75. The first bend 74 can be shaped to transition from oriented outward to being oriented upward. The first extension 95 can extend away from the first bend 74 and be substantially parallel to the retainer axis 75. Additionally, the first extension 95 can be angled toward the retainer axis 75 or away from the retainer axis 75. The first extensions 95 may form the inner surface 79. The tabs 73*a*, 73*b* can extend in substantially the same plane as the first extension 95 (depicted as upward in FIG. 6). The detent projections 77 can extend inward from the first extension 95 with respect to the retainer axis 75.

The second bend 76 can flexibly extend from the first extension 95. The second bend can be formed to transition from oriented away from the first bend 74 to oriented towards the first bend 74 in respect to along the retainer axis 75 and outwards with respect to the retainer axis 75. The second extension 96 can extend away from the second bend and outward from the second bend 76 with respect to the retainer axis 75. The third bend 78 can flexibly extend from the second extension 96.

The third bend 78 can be formed to transition from oriented downwards and outwards to oriented downwards and inwards, with respect to the retainer axis 75. The third extension 97 can extend downwards and inwards from the third bend 78 with respect to the retainer axis 75.

Figure 7:
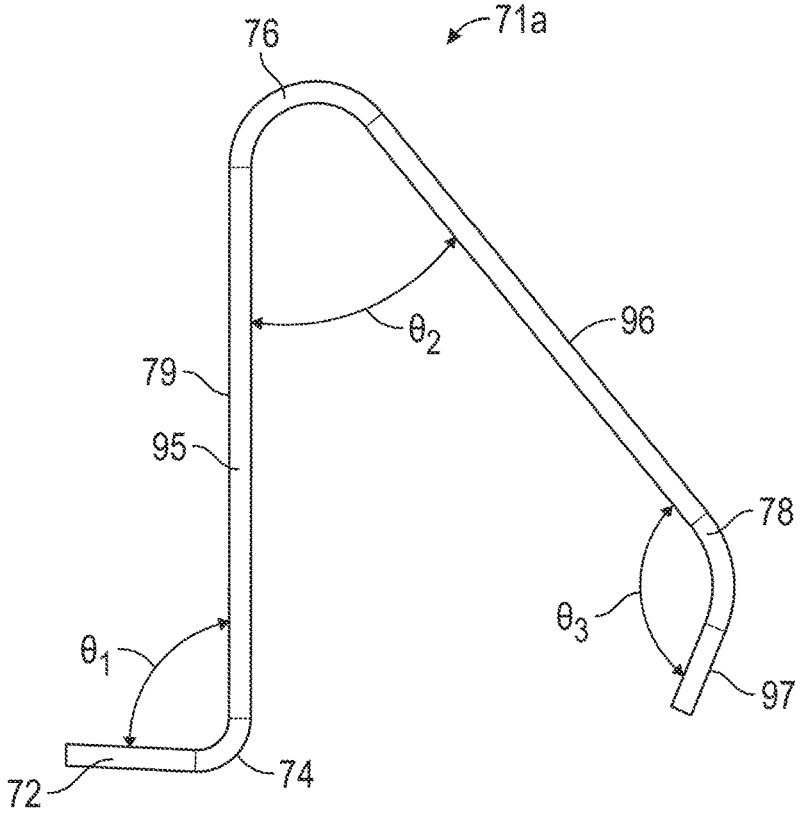
FIG. 7 is a cross section view of the center leg shown in FIG. 6.

FIG. 7 is a cross section view of the center leg shown in FIG. 6. The first bend 74 can be formed to have a constant radius that can range between 0.5 mm and 1.5 mm. The first bend 74 can transition from the skirt 72 to the first extension 95 at an angle θ1. Angle θ1 can range from 85 to 90 degrees.

The second bend 76 can be formed to with a constant radius that can range between 1 mm and 2 mm. The second bend 76 can transition from the first extension to the second extension 96 at an angle θ2. Angle θ2 can range from 30 to 75 degrees.

The third bend 78 can be formed to have a constant radius that can range between 3 mm and 4 mm. The third bend 78 can transition from the second extension 96 to the third extension at an angle θ3. Angle θ3 can range from 110 to 140 degrees.

Figure 8:
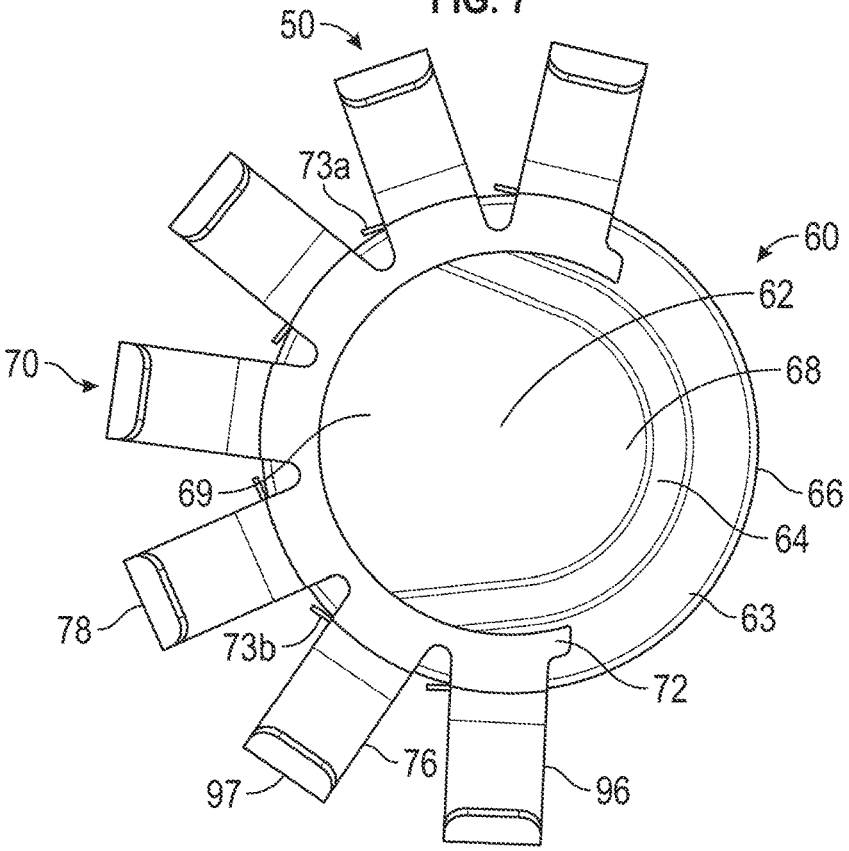
FIG. 8 is a side view illustrating a cooperative arrangement between the lock of FIGS. 4 and 5 and the retainer sleeve of FIGS. 6 and 7.
Figure 9:
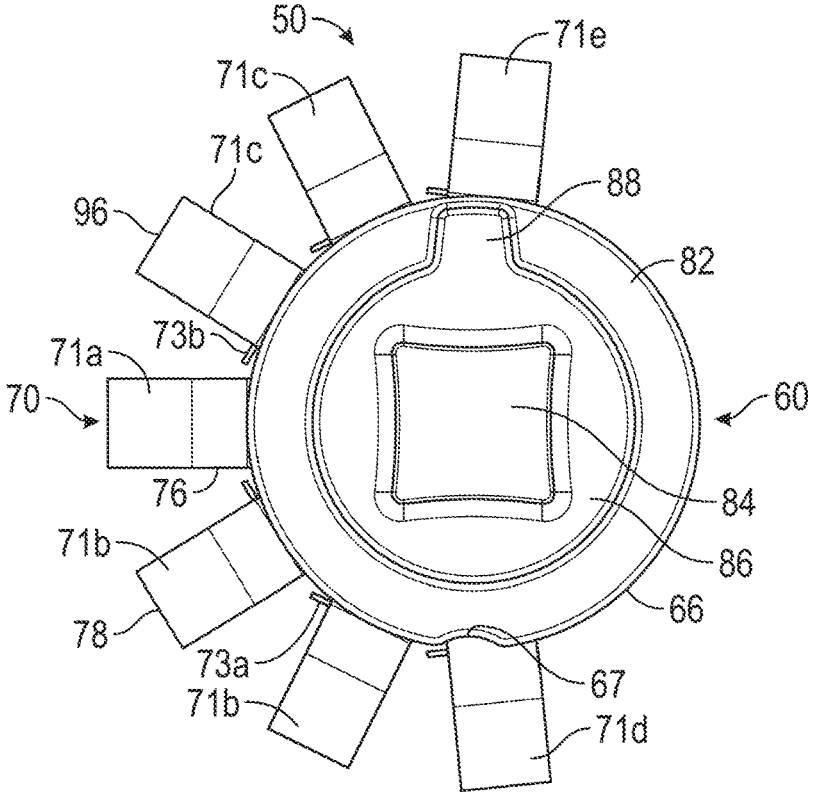
FIG. 9 is an opposite side view illustrating the cooperative arrangement between the lock and the retainer sleeve of FIG. 8.
Figure 10:
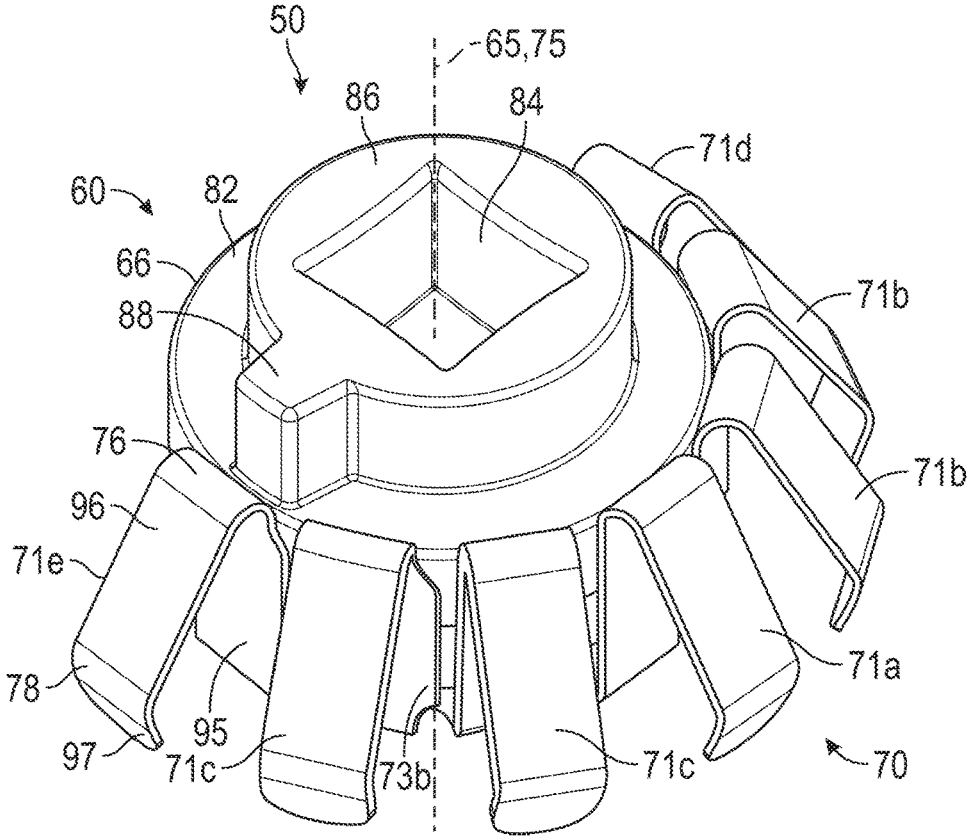
FIG. 10 is a perspective view illustrating the cooperative arrangement between the lock and the retainer sleeve of FIG. 8.

Referring to FIGS. 8-10, retainer sleeve 70 may be formed to mate with inner surface 43 of lock cavity 40. For example, retainer sleeve 70 may include a legs 71*a*, 71*b*, 71*c*, 71*d*, 71*e* forming a frustoconical shape formed to mate with a corresponding frustoconical portion of inner surface 43 in lock cavity 40. When retainer sleeve 70 is disposed within lock cavity 40 with legs 71*a*, 71*b*, 71*c*, 71*d*, 71*e* mated to the corresponding frustoconical portion of inner surface 43, retainer axis 75 may coincide with lock rotation axis 65 of lock 60, as shown in FIG. 10.

Each leg 71*a*, 71*b*, 71*c*, 71*d*, 71*e* may be similarly shaped, with the differences in shape related to tabs 73*a*, 73*b* and the presence of detent projections 77. The legs 71*b*, 71*d* can include a tab 73*a* extending towards the center leg 71*a*. The legs 71*c*, 71*e* can include a tab 73*b* extending left towards the center leg 71*a*. The center leg 71*a* may not include tabs 73*a*, 73*b* and the first extension 95 of the center leg can maintain a generally rectangular shape.

As shown in FIGS. 6 and 10, the tabs 73*a*, 73*b* can have a trapezoidal shape with the long sized attached to the first extension 95 and the tapered end opposite the long side. The tabs 73*a*, 73*b* can be a portion extending parallel with and beyond the rectangular shape of the first extension 95.

Lock cavity 40 may be formed such that, when retainer sleeve 70 is seated in lock cavity 40, rotation of retainer sleeve 70 with respect to lock rotation axis 65 is substantially prevented. For example, as best shown in FIG. 2, lock cavity 40 may include a shoulder 48 extending adjacent the circumferential outer ends of inner surface 43 and abutting the circumferential outer ends of legs 71*a*, 71*b*, 71*c*, 71*d*, 71*e* of retainer sleeve 70.

In some exemplary embodiments, retainer sleeve 70 may include one or more detents for engaging corresponding detents of lock 60. For example, as shown in FIG. 6, retainer sleeve 70 may include detent projections 77 extending radially inward from end legs 71*d*, 71*e*. Detent projections 77 may be located at various positions on retainer sleeve 70. For example, detent projections 77 may be spaced approximately 180 degrees from one another around retainer axis 75.

Detent projections 77 may have various shapes. In one exemplary embodiment, each detent projection 77 may include a generally convex curved surface, such as a constant-radius surface, jutting radially inward from end legs 71*d*, 71*e* with respect to the retainer axis 75. The detent projections 77 can maintain their shape and size along a direction substantially parallel to retainer axis 75.

The legs 71*a*, 71*b*, 71*c*, 71*d*, 71*e* can form a segmented inner surface 79 facing towards the retainer axis 75. The inner surface 79 can be formed by the first extensions 95. Lock 60 may be formed to mate with inner surface 79 of retainer sleeve 70. For example, as best shown in FIGS. 4 and 5, lock 60 may include a lock skirt 63 with an outer surface 66 having a substantially the same profile as inner surface 79 of retainer sleeve 70. Outer surface 66 of lock skirt 63 may be concentric with and extend circumferentially around lock rotation axis 65. Lock skirt 63 and outer surface 66 may extend only partway around lock rotation axis 65. For example, lock skirt 63 and outer surface 66 may extend around lock rotation axis 65 substantially the same angular degree that skirt 72 of retainer sleeve 70 extends around retainer axis 75. With lock skirt 63 and outer surface 66 of lock 60 so configured, lock 60 may be seated within retainer sleeve 70 with outer surface 66 of lock 60 mated to inner surface 79 of retainer sleeve 70. When lock 60 is so positioned within retainer sleeve 70, lock rotation axis 65 may coincide with retainer axis 75.

Lock 60 may include one or more detent recesses 67 formed to engage corresponding detent projections 77 of retainer sleeve 70 to releasably hold lock 60 in predetermined rotational positions about lock rotation axis 65. For example, as shown in FIGS. 4 and 5, detent recess 67 of lock 60 may extend radially inward from outer surface 66 of lock skirt 63. Detent recesses 67 may have a shape formed to mate with detent projections 77. In the embodiment shown in FIGS. 4 and 5, detent recesses 67 may include a concave surface, such as a constant-radius curved surface, extending radially inward from outer surface 66. In some embodiments, detent recesses 67 may be spaced approximately the same distance from one another as detent projections 77. Thus, where detent projections 77 are spaced approximately 180 degrees from one another, detent recesses 67 may likewise be spaced approximately 180 degrees from one another. Accordingly, lock 60 may be positioned in retainer sleeve 70 with outer surface 66 seated against inner surface 79 of retainer sleeve 70 and detent projections 77 extending into detent recesses 67. Retainer sleeve 70 may be formed to deflect so as to allow detent projections 77 to engage and/or disengage detent recesses 67 of lock 60. For example, retainer sleeve 70 may be constructed at least partially of a flexible material, including but not limited to, a plastic material or an elastomeric material. In some embodiments, retainer sleeve 70 may be constructed wholly of such a flexible material.

According to one exemplary embodiment, retainer sleeve 70 may be constructed of self-lubricating material that may either exude or shed lubricating substance. For example, retainer sleeve 70 may be made of thermoplastic material comprising polyoxymethylene (POM), also known as Delrin®. In further example, the retainer sleeve 70 may be made of metal such as steel. Retainer sleeve 70 made of such material may exhibit low friction while maintaining dimensional stability.

Lock 60 may be constructed of metal. Alternatively or additionally, all or a portion of the surface of lock 60 may be coated with a friction-reducing material. The term "friction-reducing material," as used herein, refers to a material that renders the surface of lock 60 to have a friction coefficient ranging from approximately 0.16 to approximately 0.7. For example, at least a portion of the surface of lock 60 may be plated with zinc to reduce friction on the surface of lock 60 (e.g., surface between lock 60 and retainer sleeve 70) to a friction coefficient between approximately 0.16 to approximately 0.7.

In another exemplary embodiment, at least a portion of the surface of lock 60 may be coated with graphite powder. The graphite powder may be aerosolized and sprayed directly onto the surface of lock 60. Alternatively or additionally, the graphite powder may be mixed with a suitable solvent material and applied to the surface of lock 60 by using a brush or dipping the lock 60 into the mixture. In one exemplary embodiment, a commercially available graphite lubricant, such as the products sold under trademark SLIP Plate, may be used alternatively or additionally.

As mentioned above, lock 60 may be installed with retainer sleeve 70 in lock cavity 40 with outer surface 66 of lock 60 mated to inner skirt 72 of retainer sleeve 70 and detent recesses 67 of lock 60 mated to detent projections 77 of retainer sleeve 70. When lock 60 is disposed in this position, open end 69 of lock slot 62 may face rearward, as shown in FIG. 3. This position allows sliding insertion and removal of post 23 into and out of lock slot 62 through open end 69. Accordingly, this position of lock 60 may be considered an unlocked position.

To lock post 23 inside lock slot 62, lock 60 may be rotated with respect to lock rotation axis 65 to a locked position. In this locked position, the portion of lock skirt 63 adjacent closed end 68 may preclude sliding movement of post 23 relative to lock slot 62, thereby preventing sliding movement of tip 30 relative to adapter 20. The locked position of lock 60 may be approximately 180 degrees from the unlocked position about lock rotation axis 65. In the locked position, as in the unlocked position, detent recesses 67 of lock 60 may engage detent projections 77 of retainer sleeve 70, which may releasably hold lock 60 in the locked position.

To rotate lock 60 between the unlocked position and the locked position, sufficient torque may be applied to lock 60 with respect to lock rotation axis 65 to cause detent projections 77 and/or detent recesses 67 to deflect and disengage from one another. Once detent projections 77 and detent recesses 67 are disengaged from one another, outer surface 66 of lock skirt 63 of lock 60 may slide along inner surface 79 of retainer sleeve 70 as lock 60 rotates around lock rotation axis 65. Once lock 60 rotates approximately 180 degrees around lock rotation axis 65, detent projections 77 and detent recesses 67 may reengage one another to releasably hold lock 60 in that rotational position.

Ground engaging tools and the associated retainer systems of the present disclosure are not limited to the exemplary configurations described above. For example, ground engaging tool 10 may include a different number of lock cavities 40, and ground engaging tool 10 may employ a different number and configuration of posts 23, locks 60, and retainer sleeves 70. Additionally, in lieu of adapter 20 and posts 23, ground engaging tool 10 may employ one or more pins fixed to or integrally formed with suitable support structure.

INDUSTRIAL APPLICABILITY

The disclosed retainer systems and ground engaging tools may be applicable to various earth-working machines, such as, for example, excavators, wheel loaders, hydraulic mining shovels, cable shovels, bucket wheels, bulldozers, and draglines. When installed, the disclosed retainer systems and ground engaging tools may protect various implements associated with the earth-working machines against wear in the areas where the most damaging abrasions and impacts occur and, thereby, prolong the useful life of the implements.

The disclosed configurations of various retainer systems and components may provide secure and reliable attachment and detachment of ground engaging tools to various earth-working implements. In particular, certain configurations of the disclosed retainer systems may address certain issues associated with work material getting into the space around the retainer system and increasing friction between components of the retainer system and/or between retainer system and a ground engaging tool. Moreover, certain configurations of the disclosed retainer systems may reduce friction between components of a retainer system and/or between a component of a retainer system and a ground engaging tool.

The disclosed retainer system 50 includes lock 60 and retainer sleeve 70. The legs 71*a*, 71*b*, 71*c*, 71*d*, 71*e* of the retainer sleeve 70 is formed to mate with inner surface 43 of lock cavity 40 of tip 30, and lock 60 is formed to mate with inner surface 79 of retainer sleeve 70. To attach tip 30 to adapter 20, lock 60 and retainer sleeve 70 are assembled into lock cavity 40 of tip 30. Lock cavity 40 opens into side slot 41 that extends rearward, which allows passage of post 23 of adapter 20. Once post 23 is inserted inside lock slot 62, lock 60 is rotated about lock rotation axis 65 to a closed position. In this position, the portion of lock skirt 63 adjacent closed end 68 may preclude sliding frustoconical portion of post 23 into or out of lock slot 62, preventing sliding movement of tip 30 relative to adapter 20. In the locked position, detent recesses 67 of lock 60 may engage detent projections 77 of retainer sleeve 70, which may releasably hold lock 60 in the locked position.

To detach tip 30 from adapter 20, lock 60 is rotated from the locked position to an unlocked position to cause detent projections 77 and detent recesses 67 to disengage from one another. Once detent projections 77 and detent recesses 67 are disengaged from one another, outer surface 66 of lock skirt 63 of lock 60 may slide along inner surface 79 of retainer sleeve 70, as lock 60 rotates around lock rotation axis 65. Once lock 60 rotates approximately 180 degrees around lock rotation axis 65, detent projections 77 and detent recesses 67 may reengage one another to releasably hold lock 60 in that rotational position.

The first bend 74, second bend 76, and third bend 78 are formed to provide flexibility and a spring like effect to the legs 71*a*, 71*b*, 71*c*, 71*d*, 71*e* to help accommodate variances in the lock 60 and lock cavity 40 dimensions. The form of the legs 71*a*, 71*b*, 71*c*, 71*d*, 71*e* can produce a compressive force against the lock cavity 40 to hold the lock 60 in place. The spring like form of the retainer sleeve 70 can facilitate install in the lock cavity 40.

During manufacturing, the lock cavity 40 can be made slightly larger or smaller in comparison to the design dimensions. In a least material condition (LMC) of the lock cavity 40, the legs 71*a*, 71*b*, 71*c*, 71*d*, 71*e* can be pre-formed in anticipation for a LMC and can provide a tight fit with the inner surface 43 of the lock cavity 40. In a maximum material condition (MMC) of the lock cavity 40, the legs 71*a*, 71*b*, 71*c*, 71*d*, 71*e* can compress, via flexing in the first bend 74, second bend 76, and third bend 78, towards the retainer axis 75 to accommodate a tighter fit. The tight fit keeps the lock 60 and the retainer sleeve 70 concentric and in the proper position.

Similarly, In a LMC of the lock 60, the first bend 74 and first extension 95 of the legs 71*a*, 71*b*, 71*c*, 71*d*, 71*e* can be pre-formed in anticipation for a LMC and can provide a tight fit with the inner surface 43 of the lock cavity 40. In a MMC of the lock 60, the first extension 95 can compress, via flexing in the first bend 74, towards the retainer axis 75 to accommodate a tighter fit. The tight fit can prevent the lock 60 from rotating to an unlocked position.

The first bend 74 can be formed and flexed to encourage the first extension 95 to induce a compressive force against the outer surface 66. The second bend 76 can be formed and flexed to encourage the second extension 96 and the third bend 78 to induce a compressive force against the inner surface 43 of the lock cavity 40 that can keep the retainer sleeve 70 centered about the lock rotation axis 65. The third bend 78 can be formed and flexed to encourage the third extension 97 to induce a compressive force against the inner surface 43 of the lock cavity 40 to prevent the retainer sleeve 70 from falling out during use.

The tabs 73*a*, 73*b* can be formed to be oriented towards the center leg 71*a* to prevent overlapping of the legs 71*a*, 71*b*, 71*c*, 71*d*, 71*e* during events such as compression, heat treatment, and transportation.

Although this invention has been shown and described with respect to detailed embodiments and examples thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of earth working machine. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. It is appreciated that features shown or discussed in one embodiment or example can be combined with other features shown or discussed in other embodiments and examples. The embodiments are not limited to those that solve any or all of the stated problems or those that have any or all of the stated benefits and advantages.

What is claimed is:

1. A retainer sleeve for use with a lock in a ground engaging tool with a lock cavity, the lock having an outer surface and a detent recess, the retainer sleeve comprising:

a skirt extending part way around a retainer axis to form a portion of an annulus;

a plurality of legs joined to the skirt and formed to mate with the lock cavity of the ground engaging tool, the plurality of legs forming an inner surface shaped to rotatably receive the outer surface of the lock; and wherein each of the plurality of legs comprises a first bend extending from the skirt, a first extension extending from the first bend, a second bend connected to the first extension, the second bend extending outward with respect to the retainer axis, a second extension extending outward from the second bend with respect to the retainer axis, a third bend extending from the second extension, and a third extension extending inward from the third bend with respect to the retainer axis.

2. The retainer sleeve of claim 1, wherein one or more of the plurality of legs comprises:

a detent projection extending radially inward from the plurality of legs with respect to the retainer axis and formed to engage the detent recess of the lock to releasably hold the lock.

3. The retainer sleeve of claim 1, wherein the skirt is formed as a "C" shape.

4. The retainer sleeve of claim 1, wherein the skirt extends more than 180 degrees around the retainer axis.

5. The retainer sleeve of claim 1, wherein the inner surface is an inner surface of each of the first extensions of each of the plurality of legs.

6. A retainer sleeve for use with a lock in a ground engaging tool with an inner surface of a lock cavity, the lock having an outer surface and a detent recess, the retainer sleeve comprising:

a skirt extending around a retainer axis;

a plurality of legs formed to mate with the inner surface of the lock cavity of the ground engaging tool, formed to rotatably receive the outer surface of the lock, and having a detent projection extending radially inward from one or more of the plurality of legs with respect to the retainer axis and formed to engage the detent recess of the lock to releasably hold the lock; and wherein each of the plurality of legs comprises a first bend extending outward and generally transverse from the skirt, a first extension extending from the first bend, a second bend connected to the first extension, the second bend extending outward with respect to the retainer axis, a second extension extending outward from the second bend with respect to the retainer axis, a third bend extending from the second extension, and a third extension extending inward from the third bend with respect to the retainer axis.

7. The retainer sleeve of claim 6, wherein at least one of each of the plurality of legs include a tab extending from the first extension.

8. The retainer sleeve of claim 6, wherein the first bend is formed to bend to encourage the positioning of the first extension such that the first extension induces a compressive force with an outer surface of the lock.

9. The retainer sleeve of claim 6, wherein the detent projection extends radially inward as a convex surface, with respect to the retainer axis, from one or more of the plurality of legs, the detent projection extending substantially parallel with the retainer axis.

10. The retainer sleeve of claim 6, wherein the skirt has a "C" shape.

11. The retainer sleeve of claim 6, wherein the second bend is formed to provide a spring like effect, whereby the second bend encourages the second extension to induce a compressive force against the inner surface of the lock cavity.

12. The retainer sleeve of claim 6, wherein the first bend, second bend, and third bend are formed with a constant radius.

13. The retainer sleeve of claim 12, wherein the first extension is angled between 85 and 90 degrees from the skirt.

14. A retainer system for a ground engaging tool, comprising:

a lock including:

a head having a tool interface;

a lock skirt extending from the head and including an outer surface; and a detent recess formed on the outer surface of the lock skirt; and a retainer sleeve including a skirt extending part way around a retainer axis to form a portion of an annulus, and a plurality of legs joined to the skirt and formed to mate with a lock cavity of the ground engaging tool, forming an inner surface shaped to rotatably receive the outer surface of the lock; and wherein each of the plurality of legs comprises a first bend extending from the skirt, a first extension extending from the first bend, a second bend flexibly connected to the first extension, the second bend extending outward with respect to the retainer axis, a second extension extending outward from the second bend with respect to the retainer axis, a third bend extending from the second extension, and a third extension extending inward from the third bend with respect to the retainer axis.

15. The retainer sleeve of claim 14, wherein the second extension is angled between 30 and 70 degrees from the first extension.

16. The retainer sleeve of claim 14, wherein the third extension is angled between 110 and 140 degrees from the second extension.

17. The retainer system of claim 14, wherein the first bend has a radius between 0.5 mm and 1.5 mm.

* * * * *